United States Patent [19]

Crimmins, Jr.

[11] Patent Number: 4,603,497

[45] Date of Patent: Aug. 5, 1986

[54] MEANS FOR SECURING AND ALIGNING THE BARRELS OF TWO PISTOLS SUBSTANTIALLY PARALLEL

[75] Inventor: Arthur G. Crimmins, Jr., Tillamook, Oreg.

[73] Assignee: Joan M. Crimmins, Lansdale, Pa.

[21] Appl. No.: 586,207

[22] Filed: Mar. 5, 1984

[51] Int. Cl.[4] ..... F41C 27/00

[52] U.S. Cl. ..... 42/106; 42/71.02; 42/72

[58] Field of Search ..... 42/1 R, 71 R, 71 P, 42/72, 75 A, 77; 89/1.41, 1.42, 37.15, 126, 136

[56] References Cited

U.S. PATENT DOCUMENTS

| | | | |
|---|---|---|---|
| 573,353 | 12/1896 | Potts | 89/1.41 |
| 839,978 | 1/1907 | Adrianson | 42/1 R |
| 1,386,247 | 8/1921 | Fordyce | 42/71 R |
| 2,108,060 | 2/1938 | Green | 89/1.42 |
| 2,752,825 | 7/1956 | Crigger et al. | 89/1.41 |

*Primary Examiner*—Charles T. Jordan
*Assistant Examiner*—Ted L. Parr
*Attorney, Agent, or Firm*—Samuel V. Abramo

[57] ABSTRACT

A platform having two clamps for securing the barrels of two pistols substantially parallel permitting the operator of the two pistols, using both hands, to hold said pistols by their hand grips and to aim and fire the pistols at the same target simultaneously and/or successively, whereby stability of the two aimed pistols is imparted during repeated firing.

4 Claims, 6 Drawing Figures

MEANS FOR SECURING AND ALIGNING THE BARRELS OF TWO PISTOLS SUBSTANTIALLY PARALLEL

FIELD OF THE INVENTION

This invention is directed to means for securing the barrels of two pistols parallel to each other to permit a user of said pistols to aim and fire said pistols at the same target.

BACKGROUND OF THE INVENTION

The original invention of a handheld pistol and the ultimate design of the pistol was dictated by the mechanics of the human hand and the way a pistol felt to the user. These mechanics do not readily lend themselves to a need to align the barrel and minimum movement of the pistol during use with a point of major support of the user's body in the same way a rifle is used. In general, the normal design of a pistol establishes, during its use, a reactive thrust vector of the barrel at a point appreciably different from the major supporting structure of the hand. The result is that there is a moment generated when the weapon discharges and this moment invariably results in "muzzle jump", e.g., a displacement of the barrel from the original target. This "muzzle jump" sharply lowers the effective rate of fire of a pistol since the displacement of the barrel necessitates resighting the pistol, e.g., the user must return the hand holding the pistol to a point where the pistol is once again aimed in the direction of a target for each subsequent discharge or firing of the pistol.

Modern combat shooting or firing techniques involve the use of both hands to stabilize the weapon both before and after firing wherein one hand holds the pistol by its grip and the other hand grasps the hand or wrist of the hand holding the pistol. Substantial improvement and accuracy over one handed firing methods has proven this method to be of assistance to the shooter. A further advance has been made through the use of optical sighting systems that provide a better sight picture and often allow the user to fire the weapon with both eyes fully open.

The present invention is an apparatus for mounting two pistols together, the barrels of each pistol being in parallel position to each other, with a sight arranged to aim both pistols at the same target. It is apparent that the apparatus provides for the use of both hands of the shooter on the two pistols in a novel and highly effective manner wherein one pistol is held by the grip by one hand and other pistol is held by the grip by the other hand. In a preferred form of the invention, a mechanism is provided for the attachment of two standard pistols to a single sighting device and means for adjusting the impact point of both weapons to the desired single point of a target as defined by the sighting device. Automatic pistols, e.g., the Colt 45 as used by the United States Army can also be easily mounted by use of metal plates replacing one of the grips as is a common practice for mounting optical sights on such weapons. The novel arrangement discussed herein allows the user to effectively counter the muzzle jump as the generated moment finds a reactive force in the hand of the shooter opposite the discharged weapon, especially if the user extends his arms to a straight position after grasping the hand grips as aforesaid.

SUMMARY OF THE INVENTION

This invention is directed to an apparatus for holding two pistols in an aligned position for firing at the same target comprising a framework having a sighting means, either optical or normal "iron sights", a first attachment means for attaching a pistol to one side of this framework and a second attachment means for attaching a second pistol to the other side of the framework whereby the barrels of each pistol are substantially parallel and are aimed at substantially the same target and stability of the combination is improved during repeated simultaneous or successive firing of the pistols.

This invention is directed to the combination of two conventional pistols each having a barrel, a hand grip and a trigger of means, comprising a support member fixedly securing both pistols, whereby the two barrels are aligned substantially parallel to each other, the pistols when aimed at by an operator point essentially at the same direction and the operator, using each hand, can hold the pistols by the hand grip to manipulate the trigger of each pistol.

BRIEF DESCRIPTION OF THE DRAWINGS

A better understanding of the present invention may be had from consideration of the following detailed description taken in conjunction with the accompanying drawing in which.

DESCRIPTION OF THE PREFERRED EMBODIMENTS

Figure 6:
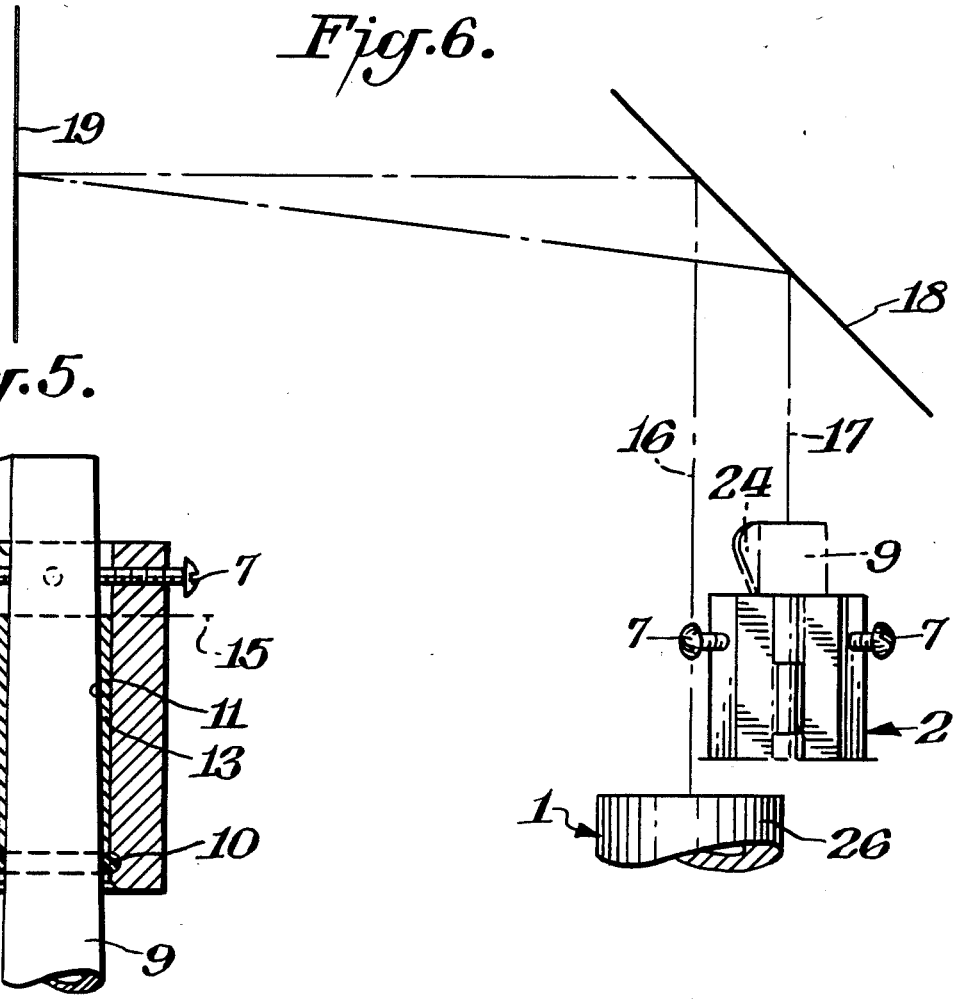
FIG. 6 is a method of alignment.

As seen in FIGS. 1 to 6 and in accordance with the embodiment of the present invention, the pistol clamping assembly 1 has a sighting device 26 which is mounted on a framework 2 consisting of a lower support frame 32 which accepts two upper clamping pieces 3 and 4 to mount weapons 5 and 6, respectively. These upper clamps 3 and 4 are secured to the framework 2 by screws 8 and hinges 14. A first pistol is clamped to the framework by a clamp having a lower pistol barrel holding a component or first lower fixed clamp 33 attached to the framework adapted to accept one-half of the cross-section of the barrel of a pistol 9. A first upper clamp 3 adapted to accept the other half of the cross-section of the barrel of the first pistol is hingedly attached to the fixed lower clamp by a hinge 14 which secures the pistol barrel when in the closed position and is retained in closed position by a thumb screw 8. The second pistol is clamped to the framework by a second lower fixed clamp 34 attached to said framework, said lower fixed clamp being adapted to accept one-half of the cross-section of the barrel of another pistol 9. A second upper clamp 4 adapted to accept the other half of the cross-section of the other pistol is hingedly attached to the right lower clamp by a hinge 14 which secures the pistol barrel when in the closed position, and is retained in closed position by a thumbscrew 8.

Figure 5:
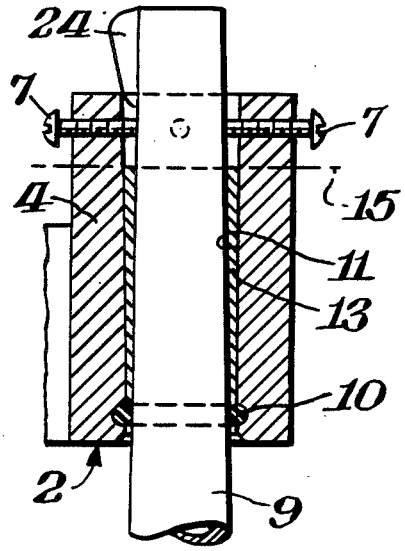
FIG. 5 is a cross sectional view taken along line 5—5 of FIG. 3 showing the mounting area.

The cut away view of FIG. 5 illustrates the method of securing the rearward end of the barrel by use of an "O" ring 10 and illustrates the contact of the upper clamp 4 with the front sight 24 of the pistol 5 attached to the barrel 9. A cavity 11 is also shown in FIG. 5 which is provided for the purpose of embedding the barrel with a suitable casting material 13 after alignment has been completed. Line 15 illustrates the maximum forward position of the casting material if the weapons are to be easily removable.

Alignment screws 7 are used to establish the precise position of the barrel required for accurate alignment of the pistols for shooting. Preferably, four alignment screws 7 are used per barrel; however, a smaller or larger number of alignment screws would serve the same purpose.

Figure 4:
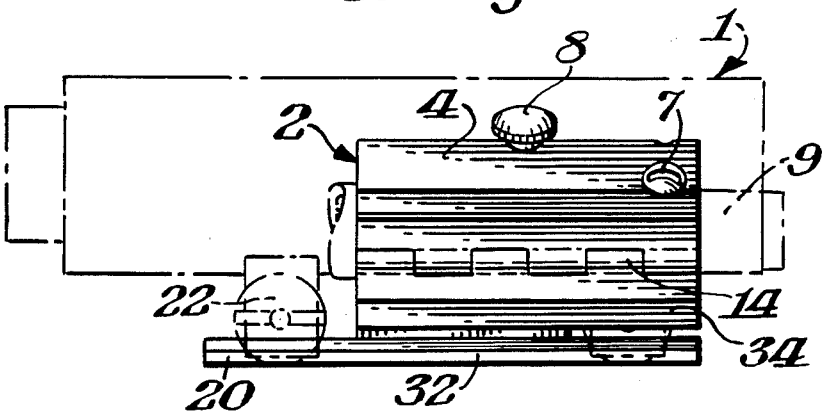
FIG. 4 is a side elevational view of the mounting arrangements shown in FIGS. 2 and 3.

FIG. 4 is a side view including a sighting device 26 for aiming both pistols so mounted, mounting screws 22, and the sighting device attachment point 20.

Figure 3:
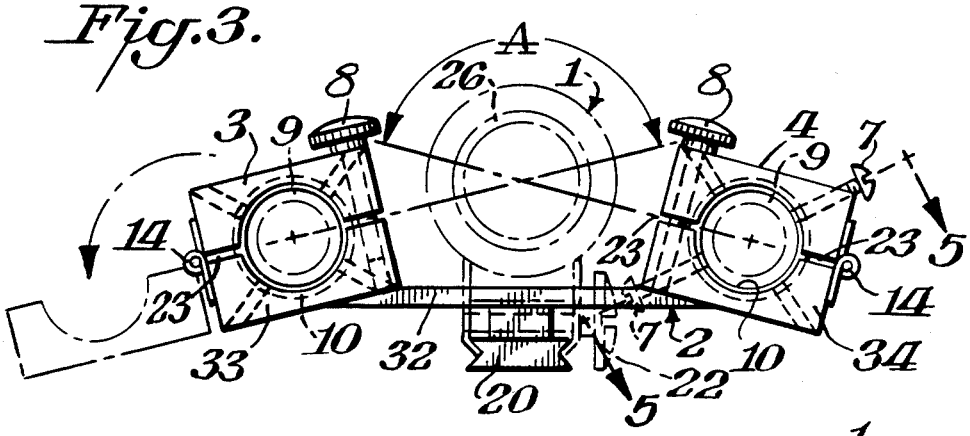
FIG. 3 is an end elevational view of FIG. 2 showing an angle displacement of the weapons and the coincidence of the centerline of the pistols with the center aiming point of the sighting device.

FIG. 3 schematically illustrates the offset of the system, angle A, having an approximate angle of about 140 to 150 degrees, which also may be desirable for the convenience of the user in holstering the twin weapons.

FIG. 6 illustrates a bench alignment method to align the pistols and sight wherein the assembly is mounted vertically and mirror 18 reflects the centerline 16 of the sight 26 of the pistol clamping assembly 1 and the centerline 17 of the barrel 9 to the target 19. This arrangement facilitates insertion of the casting material into cavity 11 as shown in FIG. 5.

Figure 1:
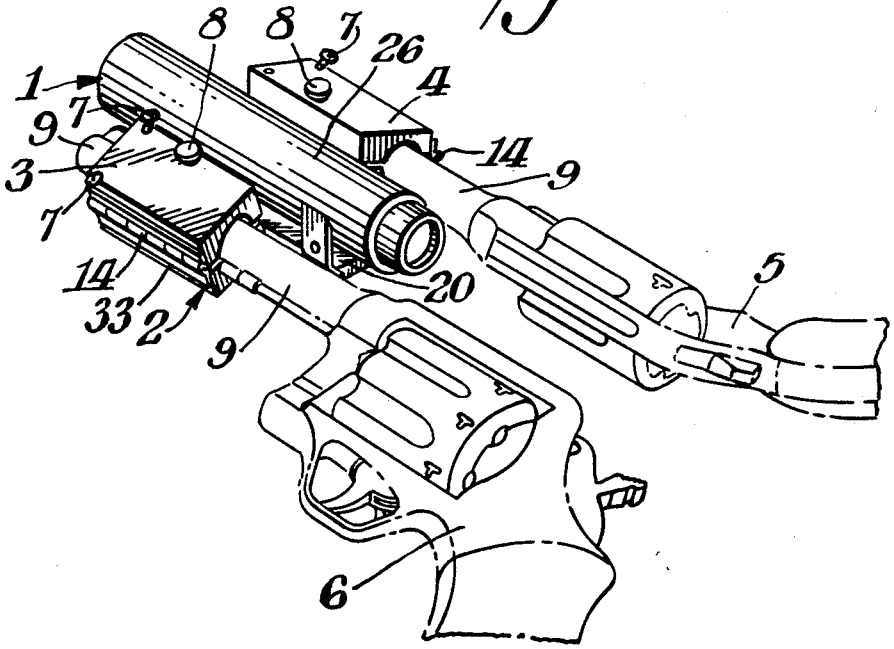
FIG. 1 is a pictorial view of the system showing two hand pistols mounted in a single frame incorporating a sighting device.
Figure 2:
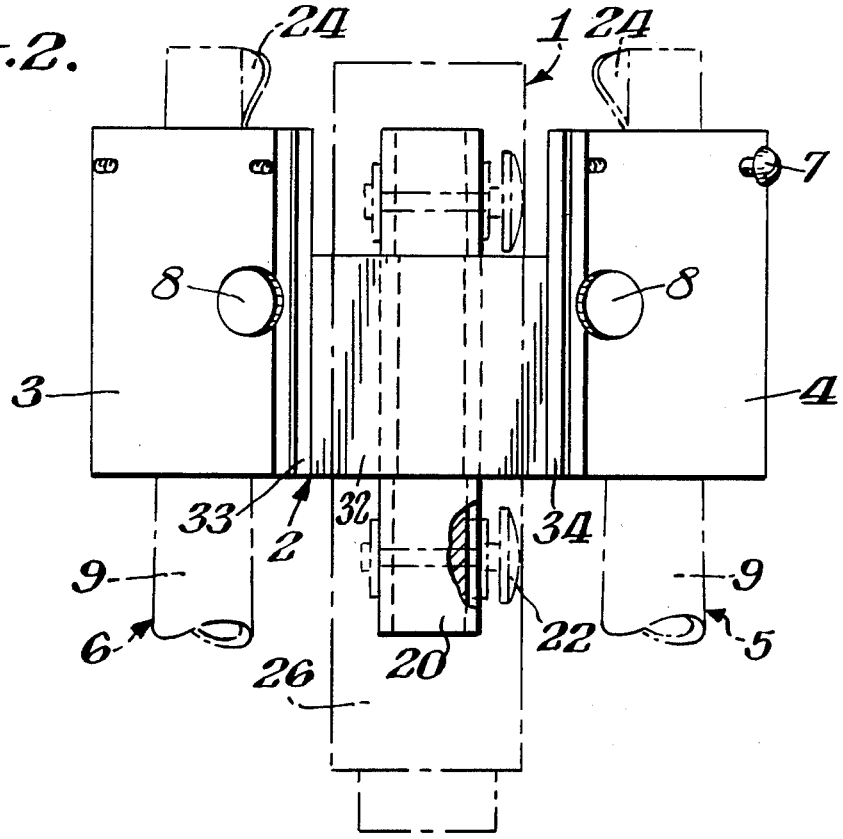
FIG. 2 is a top view of the two pistol mounting frames.

Weapons 5 and 6 in FIG. 1 are optically aligned by adjusting screws 7 until the point of aim of each barrel of each gun match the aim point, generally substantially the same point on a target, as established by the sighting device 26. After the alignment has been completed, a suitable casting compound is inserted into cavity 11, up to line 15 as shown in FIG. 5 around the barrels of both guns, and allowed to solidify. This casting agent should be selected based upon either no change in the dimension of the casting material upon solidification or very slight expansion of the said casting material. Such materials are well known and are used extensively in the machine industry.

By applying a mold releasing agent to the appropriate surfaces and preventing the casting material from coming in contact with screws 7 by virtue of limiting the forward position of the casting material to a point defined by line 15 in FIG. 5 (or heavily coating screws 7 with said mold release agent), the weapons may be removed and replaced into the apparatus as may be desired without the need for realignment after each removal. This is possible as the casting material will remain firmly attached to the barrel as a bushing that precisely fits the holding apparatus if the mold release agent is applied to the apparatus. If the mold release agent is applied to the barrel and parting shims are inserted into the areas designated 23 in FIG. 3, then the casting material will adhere to the apparatus and the barrel will be released free of any cast bushing as previously described.

There are obviously many well known methods of attaching devices to each other that could be used. These range from magnets to half-turn assemblies that are very well known to those versed in the art whereby the two weapons can be secured to the holding apparatus without departing from the herein described invention.

An advantage in the use of the herein described invention for law enforcement which is not immediately obvious or expected is the possibility of carrying several nonlethal rounds in one of the weapons. In the current situation where only one gun is used, it would be highly impractical and extremely dangerous to load several nonlethal rounds, for example tear gas shells, in the cylinder when a single gun is carried in normal police duty. In the event of a life threatening situation, the law enforcement official would be forced to fire two harmless rounds before he could access a normal bullet. Thus, since nonlethal options are not available, the officer is always forced to respond with a potentially lethal assault from a single gun. With the presently described invention the second gun could easily carry two or more nonlethal rounds, for example, several tear gas shells and one with multi-projectile (shot) shell of limited power. In a confrontation, the policeman could feel confident in firing the nonlethal rounds knowing that the other gun was loaded with normal ammunition that could be brought into use instantly if the nonlethal rounds failed to deter the aggressive law breaker.

The angle A as shown in FIG. 3 is significant when the weapon is to be carried in the holster as is normal in police operations. The angle is selected based upon the comfort of the wearer in a hip, thigh, or "shoulder holster" mounted system. Experiment has shown that it is convenient and preferred for angle A to be 144 degrees; however, other angles in the range of 130 to 175 degrees can be used.

The framework holds the pistols in a substantially parallel position or in a manner which aims the pistols at a common point in normal pistol range. The distance between the barrels of the pistols held in the framework is preferably 1 to 2 inches but can be 0.5 to 4 inches or more.

This invention is particularly suited to firearms with easily detachable barrels, such as the Dan Wesson line of revolvers, as substitute barrels could be permanently attached and the main framework removed and supplied with other barrels for normal use of the weapon. Also well suited are weapons with multiple barrels, such as 4-barrel derringers, as such weapons may be easily attached to the holding apparatus.

Other embodiments of the invention include a camera activated by the trigger and a safety release device which prevents another person from firing the pistols. Thus it can be advantageous to a law enforcement official to have a photographic record of a situation that required the use of his weapon. An optical sighting means could be, in effect, the view finder of a camera that could be conveniently mounted below the framework with an automatic film advance system as is well known to those versed in the art. This camera could be activated by a simple cam switch detecting trigger or cylinder movement.

The object of the safety release device is to prevent a law enforcement officer from being wounded by his own weapon. This embodiment comprises incorporating on the claimed device or on a single pistol an individual safety system which would be keyed to the legitimate owner of the weapon. Such a system could involve the use of tattooing of the user's thumb with ink that would be visible under ultraviolet light and a suitable recognition means built into the handgrips of the system that would release the weapon safety system only when positive identification of the user had been established. If the weapons used were of the revolver category, a simple cam action could be used to interfere with the rotation of the cylinders as such a rotation is absolutely essential for the operation of any such modern firearm.

Thus, although there has been described above specific arrangements for the assembly or fabrication of guns into one unit in accordance with the invention for purposes of illustrating the manner in which the invention may be used to advantage, it will be appreciated that the invention is not limited thereto. Accordingly, any and all modifications, variation or equipment arrangements not limited to those described or mentioned above which occur to those skilled in the art should be considered to be within the scope of the invention and defined in the following claims.

I claim:

1. The combination, with two conventional pistols, each having a barrel, a hand grip and a trigger, of means, comprising a support member fixedly securing both pistols in substantially parallel alignment whereby each pistol is aimed at substantially a single point on a target by an operator using one hand on one hand grip and the other hand on the other hand grip, permitting manipulation of the trigger of each pistol for simultaneous or successive firing.

2. A device for securing two pistols, each having a barrel, a hand grip and a trigger, wherein the barrels are substantially parallel comprising a support member, pistol attachment means operatively connected to the support member for fixedly attaching the pistols to the support member whereby the barrels of each pistol are substantially parallel, and the pistols, when aimed by an operator point essentially in the same direction and at substantially the same point of a target, and an operator using each hand can hold the pistols by the hand grip and can manipulate the trigger of each pistol.

3. The combination of claim 1 having attached to the support member a sighting means for aiming the two conventional pistols at a target.

4. The combination of claim 1 including lethal ammunition in one pistol and nonlethal ammunition in the other pistol.

* * * * *